US005322570A

United States Patent [19]

Anderson

[11] Patent Number: 5,322,570

[45] Date of Patent: Jun. 21, 1994

[54] METHOD AND APPARATUS FOR CLEANING FEED ROLLS IN FOOD-PROCESSING MACHINERY

[75] Inventor: Joseph R. Anderson, Rockford, Mich.

[73] Assignee: APV Baker, Inc., Grand Rapids, Mich.

[21] Appl. No.: 881,709

[22] Filed: May 12, 1992

[51] Int. Cl.[5] ..... B08B 3/02

[52] U.S. Cl. ..... 134/18; 134/104.1; 134/115 R; 134/201; 141/89; 141/91

[58] Field of Search ..... 141/87, 88, 90, 93, 141/91; 118/203, 104; 101/425; 68/205 R; 222/148, 410; 134/104.1, 104.2, 115 R, 116, 172, 178, 201, 18, 42

[56] References Cited

U.S. PATENT DOCUMENTS

| | | | |
|---|---|---|---|
| 2,132,424 | 10/1938 | LeFrank | 141/91 |
| 4,213,795 | 7/1980 | Ernstsson | 141/91 |
| 4,353,398 | 10/1982 | Weiler et al. | 222/148 X |
| 4,417,610 | 11/1983 | Waldstrom et al. | 141/91 |
| 4,534,494 | 8/1985 | Hautemount | 141/91 |
| 4,842,026 | 7/1989 | Nordmeyer | 141/91 X |
| 4,852,804 | 8/1989 | Baier et al. | 134/59 |

*Primary Examiner*—Frankie L. Stinson

*Attorney, Agent, or Firm*—Price, Heneveld, Cooper, DeWitt & Litton

[57] ABSTRACT

A cleaning apparatus for a quantity-metering device includes a housing and spray nozzles for dispensing fluid onto the feed rollers of the quantity-metering device and collecting the fluid together with media which is removed from said feed rollers. The cleaning apparatus includes manifolds which carry the nozzles. The cleaning apparatus is inserted in a location vacated by a component of said quantity-metering device.

18 Claims, 4 Drawing Sheets

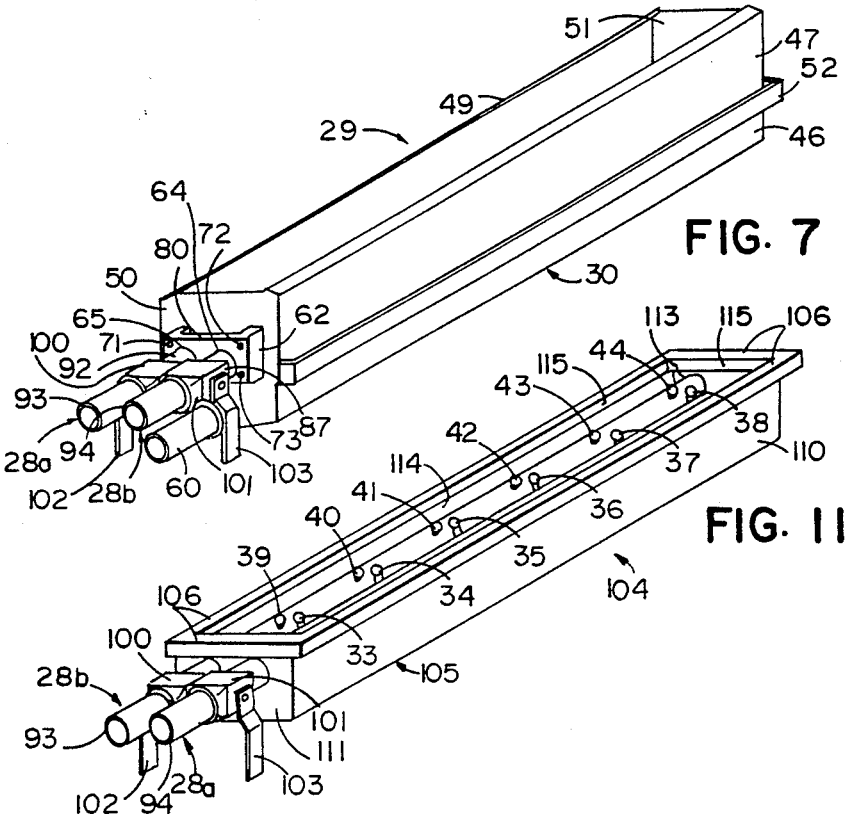
FIG. 7
FIG. 11
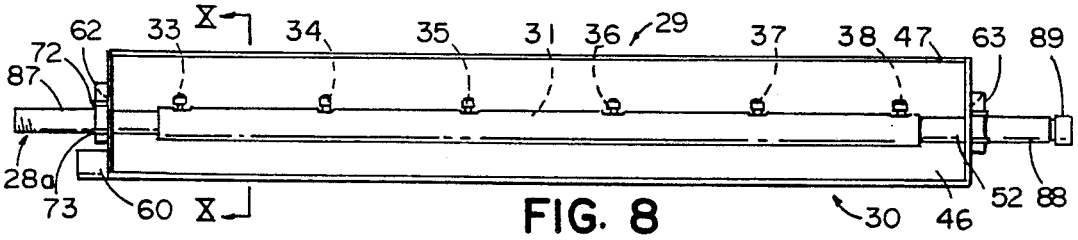
FIG. 8
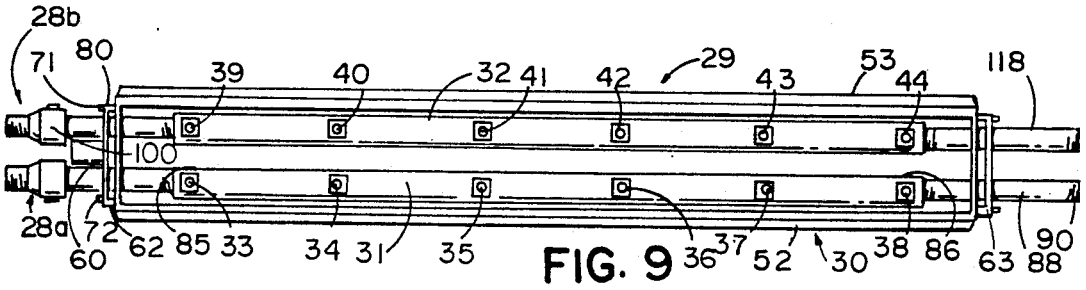
FIG. 9

METHOD AND APPARATUS FOR CLEANING FEED ROLLS IN FOOD-PROCESSING MACHINERY

BACKGROUND OF THE INVENTION

The invention relates generally to volumetric discharge devices such as extruders and the like, which will be referred to as a class hereinafter as "quantity-metering devices", used for example in manufacturing and processing operations to continuously dispense a volume or metered volumetric quantities of a flowable or plastic media such as baking doughs, confections, and the like. More particularly, the invention relates to cleaning apparatus for such quantity-metering devices, particularly for integral inclusion or association therewith. The cleaning apparatus of the present invention can be used with many particular types of quantity-metering dévices, but in a particularly desirable application the invention is used for cleaning quantity-metering devices for flowable baking dough or other food products, especially those devices known commercially as "wire-cut" machines.

Conventionally, a wire-cut quantity-metering device uses counter-rotating feed rollers supported within a hopper which force a continuous supply of baking dough downward through die extrusion cups in a die tray. A cutting wire, or knife, passes beneath each extrusion cup at repeated time intervals and slices off a short cylindrical (or otherwise shaped) segment of the baking dough on each cycle. Each segment sliced off represents an individual article such as a cookie or the like.

Another somewhat analogous machine Uses continuously-repetitive quantity-metering devices to dispense measured volumes of food product which are more accurate than the volumes dispensed by standard wire-cut devices. A significantly improved quantity-metering device is disclosed in U.S. Pat. No. 4,494,920 entitled POSITIVE-DISPLACEMENT VOLUMETRIC DEPOSITOR APPARATUS FOR BAKING DOUGH AND THE LIKE, issued to the inventor hereof on Jan. 22, 1985, and assigned to the same assignee. This machine includes a hopper and counter-rotating rollers which feed media to a volume-confining metering device, and the device outputs a continuous sequence of identical media volumes at a supply outlet by utilizing a head having a measuring cavity which is connected to the supply outlet.

Regardless of the particular type of metering device used, it is necessary that the device be cleaned following prescribed periods of use in food production. To clean the extrusion die cups used in wire-cut quantity-metering devices, the die tray including the cups is removed through an access opening in the food-processing apparatus in which the quantity-metering device is housed. Once the die tray is removed, the die cups are easily accessed for purposes of removing baking media and otherwise cleaning them.

Despite the ease with which die cups and shaping orifices are cleaned, it remains difficult and time consuming to clean the feed rollers and associated structure of wire-cut machines and other such quantity-metering devices. Typically, such rollers are initially scraped manually to remove larger quantities of media therefrom, and then scrubbed with brushes, etc. as well as hosed down with a series of cleaning agents, rinses, steam, etc. However, this process is very time-consuming and also exposes sanitation personnel to the risk of injury. Additionally, sanitation personnel may accidentally drop cleaning and scraping tools, etc. into the device during cleaning, requiring extensive disassembly and delay, or even inadvertently leave such tools in the device after cleaning is completed. Tools left in the extruder will obviously cause great problems with subsequent start-up efforts, and may well cause serious damage to the apparatus. In addition, high-pressure cleaning liquids, steam, etc. are hazardous as well as time-consuming, and also difficult to confine to a particular apparatus, splashing and spattering of adjacent machinery being a likely consequence and represent potential contamination which is highly objectionable in a food-processing environment.

An additional and related difficulty in conventional cleaning processes is preventing the flow of cleaning solutions into other parts of the apparatus being cleaned. If the solution is not confined to the rollers, for example, cleaning solution, together with media residue, will spread into other parts of the apparatus. This increases the time and difficulty of the cleaning operation, and May involve damage to parts or machinery of a sensitive nature.

SUMMARY OF THE INVENTION

The present invention provides a cleaning apparatus for internal apparatus such as feed rollers in quantity-metering devices of the type used in food-processing machinery which is readily installed for use, readily removed after use, and essentially automatic in operation, requiring no manual labor to run; while at the same time providing thorough and complete cleaning of such internal apparatus. Further, the apparatus is safe to use, and precludes the likelihood of cleaning tools and solution remaining in the food-processing apparatus when sanitation personnel are finished cleaning it. Such cleaning apparatus according to one aspect of the invention includes a housing which is adapted to be temporarily but integrally, installed upon the quantity-metering device. The housing carries a fluid dispenser having outlets through which fluid cleaning and sanitizing agents exit the dispenser. When the cleaning apparatus housing is coupled to the quantity-metering device, such fluid agents are dispensed by the fluid dispenser and directed toward and against the feed rollers and other adjacent internal structure to automatically clean it.

In another aspect of the invention, the cleaning apparatus includes a manifold having conduits providing a fluid passage therethrough. The manifold is adapted to be mounted upon a quantity-metering device at a location adjacent at least one roller in the device. A plurality of spray nozzles are carried on the manifold to dispense fluid from the fluid passage onto the roller to remove undesired media therefrom.

In yet another aspect of the invention, a method of cleaning rollers of a quantity-metering device includes mounting a cleaning apparatus having a fluid dispenser with spray nozzles upon a quantity-metering device, and supplying fluid to the dispenser for discharge onto a quantity-metering device roller through the nozzles.

Some of the more salient attributes and features of the invention include a cleaning apparatus which is specially configured for rapid and easy temporary mounting upon a quantity-metering device, particularly in an integrally associated manner such as by substitution for an outwardly similar component portion of such device that is first removed. The cleaning apparatus is self-contained, and does not utilize individual or separate cleaning tools, scraping tools, or air-blast nozzles which could remain in the extruder after cleaning; thus, the apparatus of the invention prevents the metering device from being damaged by such tools and equipment following cleaning of the internal components. The cleaning apparatus housing also serves to collect cleaning fluid dispensed from the cleaning apparatus as it drains back out of the device being cleaned, together with scraps of waste media dislodged from-the internal parts, thereby greatly facilitating and expediting the overall process and also preventing foreign matter and contaminants, including cleaning and sanitizing solutions, from entering other parts of the food-processing apparatus.

These and other features and attributes of the invention will become more apparent after contemplation of the ensuing more detailed description, particularly when considered with and in light of the accompanying drawings.

BRIEF DESCRIPTION OF THE DRAWINGS

FIG. 7 is a front perspective view of a first cleaning apparatus according to the present invention;

FIG. 8 is an enlarged side elevational view of the cleaning apparatus of FIG. 7;

FIG. 9 is a top view of the cleaning apparatus according to FIG. 7;

FIG. 11 is a front perspective view of an alternate embodiment of the cleaning apparatus according to the invention.

DESCRIPTION OF THE PREFERRED EMBODIMENTS

Figure 1:
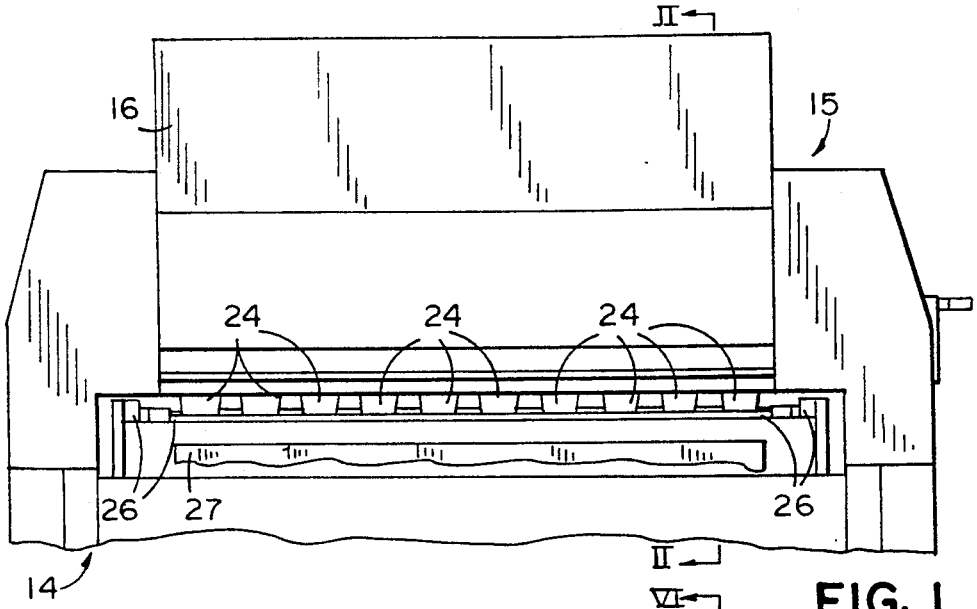
FIG. 1 is a front elevation of a typical food-processing apparatus including a volumetric quantity-metering device in which cleaning apparatus according to the present invention may be utilized.
Figure 2:
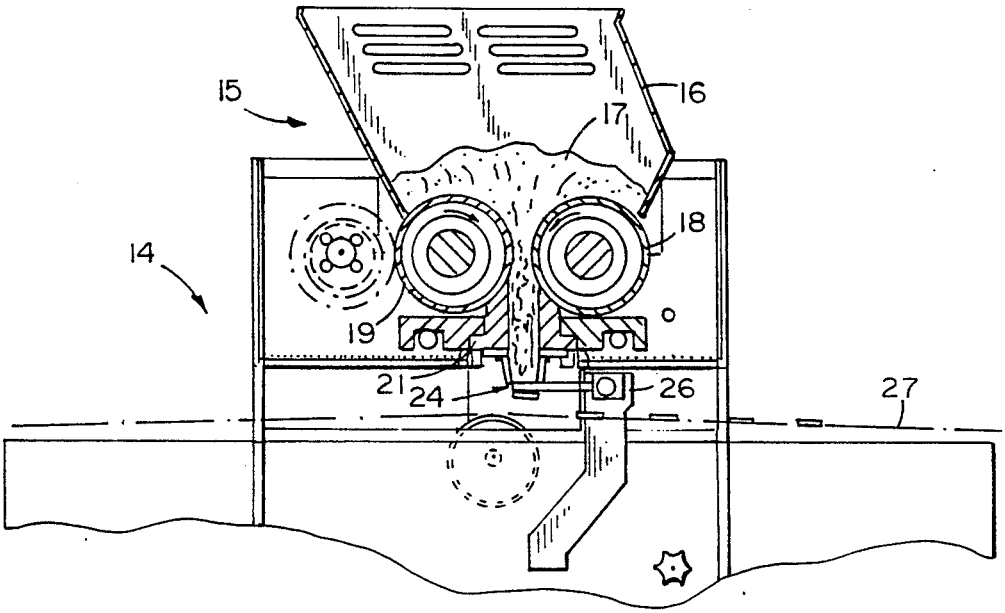
FIG. 2 is a fragmentary sectional side elevational view of the volumetric quantity-metering device, taken along plane II—II in FIG. 1.
Figure 4:
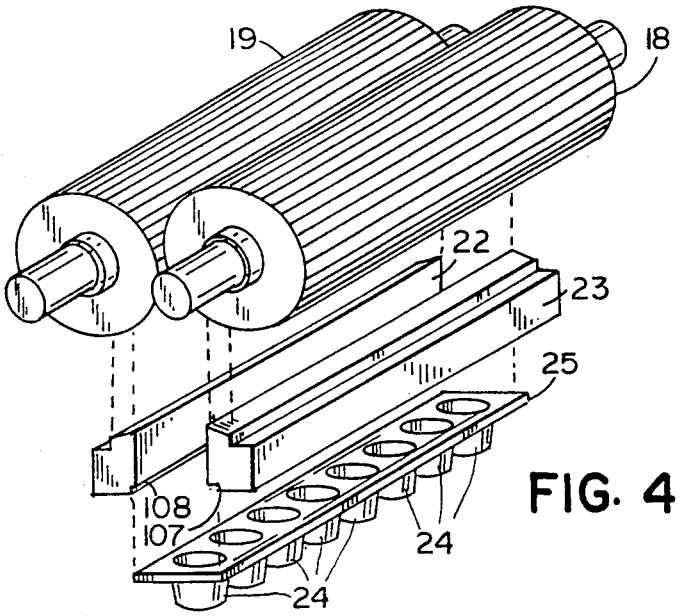
FIG. 4 is an enlarged exploded perspective view of feed rollers, scraping plates and a die plate according to another type of quantity-metering device in which cleaning apparatus according to the present invention can be utilized.
Figure 3:
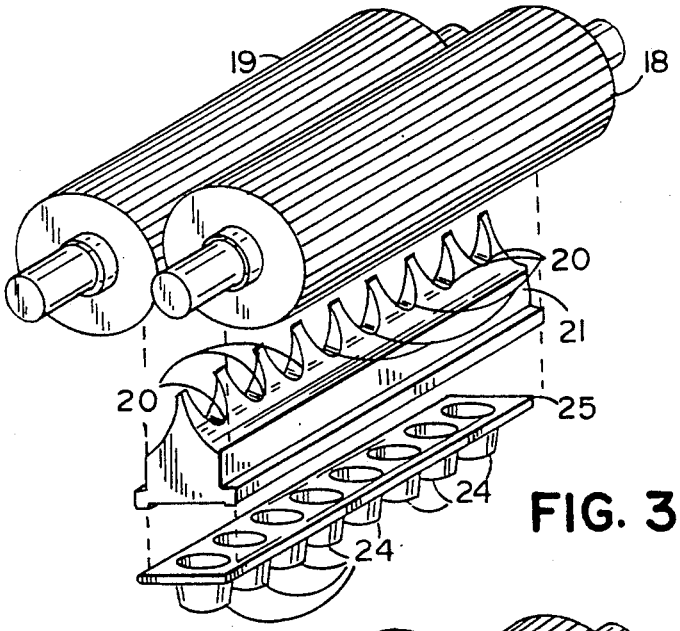
FIG. 3 is an enlarged exploded perspective view of the feed rollers, filler block and die plate of the quantity-metering device of FIGS. 1 and 2.

With reference to FIGS. 1-3, a food-processing apparatus 14 is illustrated which includes a conventional wire-cut quantity-metering device 15 for dispensing soft, plastically deformable media such as baking dough. Quantity-metering device 15 includes a hopper 16 for holding the supply of media 17 (FIG. 2), and a pair of longitudinally ridged counter-rotating feed rollers 18, 19 are supported at the bottom of hopper 16 such that rotation of these rollers feeds media 17 downwardly through a filler block 21 (FIGS. 2 and 3) and extrusion die cups 24 of a die plate 25. The filler block 21 has concave sides and fits closely between the lower extremity of rollers 18, 19 so as to channel the media flow into orifices 20 which pass the media to axially-aligned die cups 24 in die plate 25. The volumetric quantity-metering device of FIGS. 1-3 may include a pair of spaced scraping plates 22, 23 (FIG. 4), in place of filler block 21, for removing media from rollers 18, 19 and channelling it downwardly as a continuous sheet, as is well known. Regardless of whether a filler block or scraping plates are utilized during extrusion, a reciprocating wire-like cutter, or knife, 26 may be provided immediately below the die plate 25 to cut the media 17 emanating from die cups 24 into desired segments (which may be short, wafer-like objects or more lengthy cylinders). A media conveyor 27 is provided below the die cups 24 to convey the segments of extruded dough to other stages of the food-processing apparatus. Although the quantity-metering device is illustrated as a wire-cut extruder, the metering apparatus may be of any generally analogous known type, such as that disclosed in U.S. Pat. No. 4,494,920 identified above, the disclosure of which is incorporated herein by reference.

Figure 5:
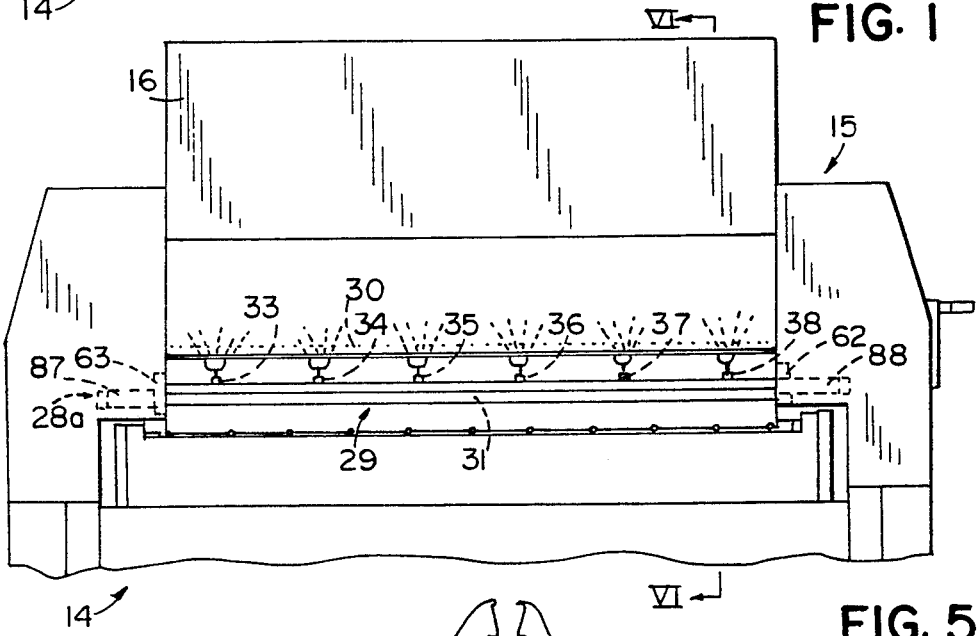
FIG. 5 is a fragmentary enlarged front elevational view of the quantity-metering device of FIG. 1 with the cleaning apparatus of the present invention installed therein.
Figure 6:
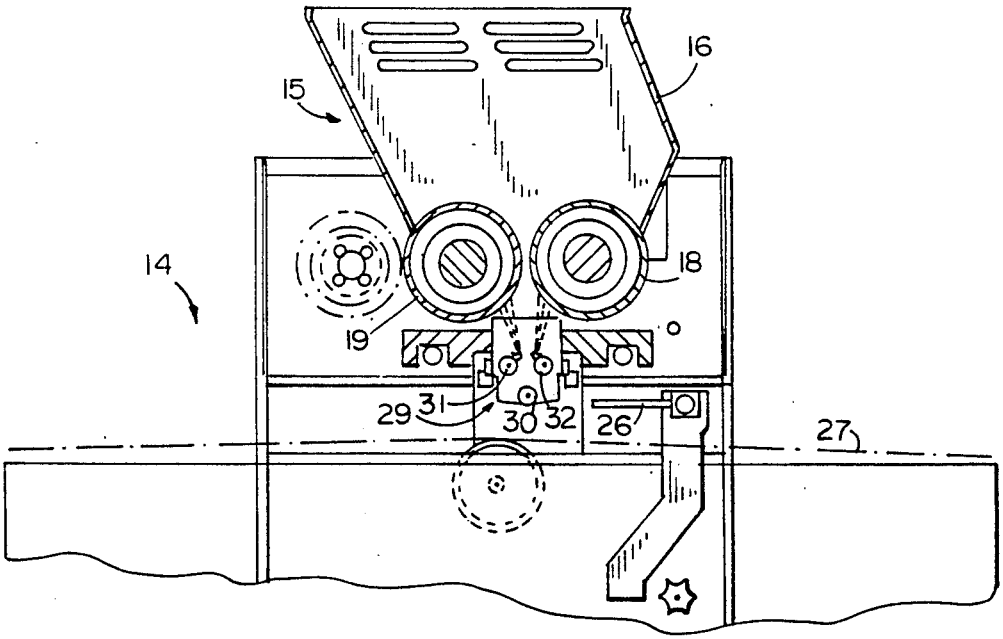
FIG. 6 is a fragmentary enlarged cross-sectional view of the quantity-metering device and cleaning apparatus, taken along plane VI—VI in FIG. 5.

With reference now to FIGS. 5 and 6, and the embodiment depicted therein, a cleaning apparatus 29 according to one embodiment of the invention is shown installed for operation in the quantity-metering device 15 of food-processing apparatus 14, below feed rollers 18, 19. Cleaning apparatus 29 includes a housing 30 which contains fluid-dispensing systems 28*a*, 28*b* (FIGS. 8-10), including respective manifolds 31, 32, which provide fluid-conveying passages through cleaning apparatus 29. Although the most preferred embodiment includes a pair of fluid-dispensing systems 28*a*, 28*b*, each for cleaning one of the two rollers 18, 19, those skilled in the art will recognize that a single fluid-dispensing system, or in other cases more than two fluid-dispensing systems, could also be used in such an installation. The fluid-dispensing systems 28*a*, 28*b* include a plurality of inclusive spray nozzles 33-44 (FIG. 9) mounted on manifolds 31, 32, to dispense fluid therefrom onto feed rollers 18, 19. In the preferred embodiment, nozzles 33-38 on manifold 31 are for spraying fluid onto roller 18 and nozzles 39-44 on manifold 32 are for spraying fluid onto roller 19.

Somewhat more specifically, housing 30 (FIGS. 5-10) of cleaning apparatus 29 is configured so as to fit directly into the space normally occupied by filler block 21 (FIG. 3) and die plate 25. Those skilled in the art will recognize that housing 30 may also be configured to occupy the space vacated by a continuously repetitive quantity-metering device such as that illustrated in U.S. Pat. No. 4,494,920 referenced above. Housing 30 is most preferably of substantially the same length as rollers 18, 19, and constructed of a non-corrosive material. For example, housing 30 may be constructed from stainless steel, or a suitable plastic. Housing 30 (FIG. 10) includes oppositely disposed lower sidewalls 46 and 48, upper sidewalls 47 and 49, endwalls 50 and 51, and integral sidewall troughs 52, 53 for collecting fluid which falls alongside upper sidewalls 47 and 49. The lower sidewalls 46, 48 are separated from their respective upper sidewalls 47 and 49 by elongated apertures 54 and 55, respectively. Apertures 54, 55 provide fluid passages between troughs 52, 53 and the interior of housing 30. Troughs 52, 53, and apertures 54, 55, extend substantially the entire length of housing 30. A housing bottom 56 is formed by two sections 57, 58 which slope to an apex 59. A drain outlet 60 is provided in endwall 50 adjacent apex 59. The lower portion of housing 30 defined by lower sidewalls 46, 48, endwalls 50, 51, and bottom wall 56 channel a slurry of fluid and media collected in housing 30 into drain outlet 60.

Housing 30 according to one embodiment of the invention includes sealing blocks 62, 63 (FIGS. 8 and 9) on endwalls 50, 51, respectively. Sealing blocks 62, 63 reinforce the endwalls for supporting fluid-dispensing systems 28*a*, 28*b*. Sealing blocks according to one embodiment, are formed of a resilient material, such as rubber, to seal the openings around manifold pipes 31, 32 against fluid leakage. These sealing blocks may alternately be formed of a rigid plastic or stainless steel. If the sealing blocks are constructed from a rigid material, a gasket (not shown) is preferably positioned between blocks 63, 64 and endwalls 50, 51 to prevent fluid leakage from housing 30 where fluid-dispensing systems 28*a*, 28*b* pass through endwalls 50, 51. Sealing blocks 62, 63 are identical, and thus only block 62 is described in greater detail hereinafter. Sealing block 62 includes apertures 64, 65 aligned with apertures (not shown) in endwall 50 for receiving fluid-dispensing systems 28*a*, 28*b*. Sealing block 62 also includes four bores (not shown) for receiving threaded fasteners, three of which (71–73) are shown in FIG. 7. Correspondingly spaced threaded bores 75-78 (FIG. 10) are provided in endwall 50 for receiving such threaded fasteners when sealing block 62 is attached to endwall 50. Alternately, sealing block 62 could be attached using an adhesive. Sealing block 62 further includes a pocket or trough 80 (FIGS. 7 and 9) for collecting fluid which falls downwardly along endwall 50. Trough 80 most preferably extends over substantially the entire width of sealing block 62 to collect fluid along the entire length of the sealing block. A slot-like aperture 82 in endwall 50 (FIG. 10) provides a fluid passage into housing 30 for fluid collected in trough 80.

In a preferred embodiment of the invention, housing 30 supports two fluid-dispensing systems 28*a*, 28*b*. The fluid-dispensing systems include respective manifolds 31, 32, which comprise pipe-like fluid conduits manufactured from stainless steel, copper or plastic piping, although other non-toxic material could be utilized. Fluid-dispensing systems 28*a*, 28*b* are identical, and thus only system 28*a* is described in greater detail hereinafter. Manifold 31 of system 28*a* in a preferred embodiment includes outlets in the form of threaded bores (not shown) which are aligned along the manifold and receive outlet spray nozzles 33–38 (FIGS. 5, and 8–10). The pipe-like members of manifold 31 may comprise internally threaded end portions 85, 86 (FIG. 9) which receive externally threaded main pipes 87, 88, respectively, although the paired end portions and main pipes may be unitary (one piece) if desired. Pipes 87, 88 convey cleaning fluids into housing 30, and also provide an axle on which fluid-dispensing system 28*a* slides and may be pivoted (to facilitate installation and initial setup, for example). An internally threaded cap, 89 matingly engages external threads 90 on pipe 88 to close one end of the fluid passage extending through fluid-dispensing system 28*a*.

Figure 10:
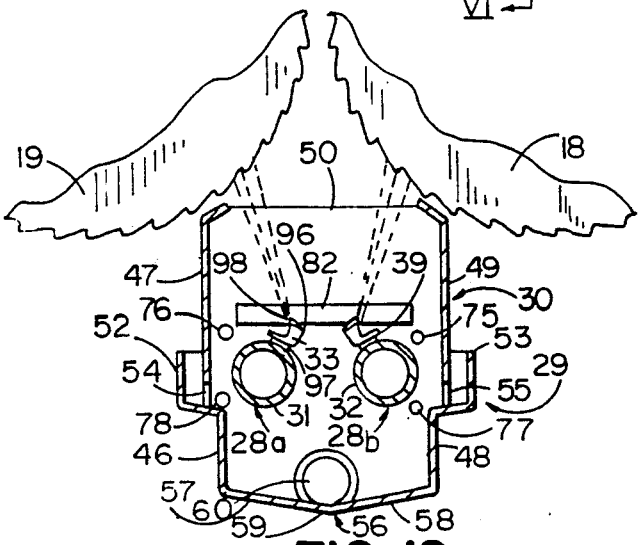
FIG. 10 is an enlarged cross-sectional view of the cleaning apparatus taken along plane X—X in FIG. 8.

Spray nozzles 33–44 can be of a type commercially available which emits a fan-shaped spray, and are formed of non-corrosive material such as brass or the like, having a head 96 (FIG. 10) integrally formed on the end of a tubular body 97. Although commercially-available such nozzles may be used, however, it is to be noted that the particular usage and combination here envisioned, involving the cleaning apparatus 29, is believed to be novel. As will be understood, the body 97 is externally threaded for mating engagement in a respective threaded bore (not shown) provided in manifolds 31, 32. The head 96 includes a fluid passage (not specifically illustrated) connected with the internal passage of manifolds 31, 32 for receiving fluid from these manifolds and dispensing the fluid outwardly through a nozzle outlet 98 (FIG. 10). The outlet 98 most preferably forms a generally conical spray pattern such that fluid is applied in a controlled manner over a relatively concentrated surface area.

The fluid-dispensing systems 28*a*, 28*b* in one embodiment of the invention include a pair of hoses 93, 94 (FIGS. 11 and 12) connected to pipes 87, 92 to supply fluid, in the form of pressurized air, water or solution, to manifolds 31, 32, respectively. In addition to cleaning solutions, a solution may be dispensed which includes a disinfectant and hot water for sterilizing feed rollers 18, 19 at the end of the cleaning process. Hoses 93, 94 are most preferably connected to manifolds 31, 32 via control valves 100, 101 (FIGS. 7 and 9). The control valves include handles 102, 103, respectively, connected to internal valve members (not shown) which control the fluid flow rate through the fluid-dispensing systems. Valves 100, 101 are of a type which is commercially available, and may be provided by a manually actuated fluid valve in the form of a gasket valve or a ceramic disk valve, however, the use of such valves in cleaning apparatus 29 is believed to be novel. As illustrated in FIG. 8, the cleaning apparatus 29 may be provided without control valves 100, 101, preferably by providing other fluid control apparatus upstream of hoses 93, 94.

Figure 12:
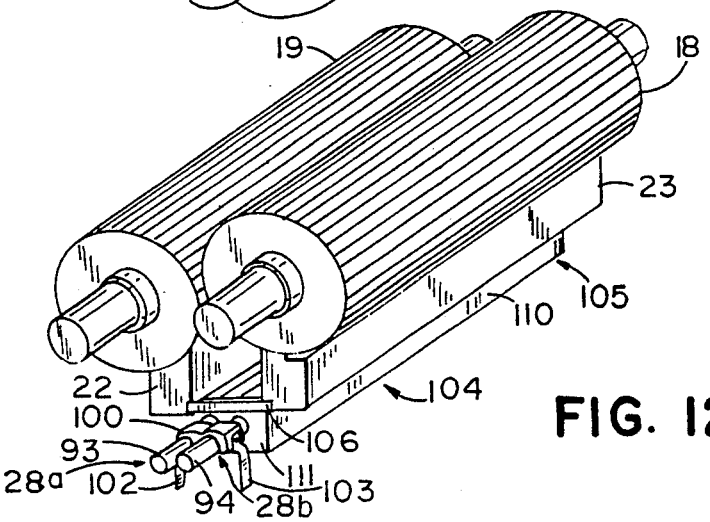
FIG. 12 is an enlarged perspective view of rollers, scraping plates, and the cleaning apparatus according to FIG. 11.

A cleaning apparatus 104 according to one alternate embodiment of the invention is illustrated in FIGS. 11 and 12. The cleaning apparatus 104 is substantially the same as cleaning apparatus 29 except for the differences specifically pointed out below. Cleaning apparatus 104 includes a housing 105, which supports fluid-dispensing systems 28*a*, 28*b*, configured to fit into quantity-metering device 15 in the space vacated by die plate 25 (FIG. 4) when the die plate is removed by sanitation personnel during cleaning. Cleaning apparatus 104 includes a housing 105 having a rim 106 circumscribing the perimeter of an opening in the top of the housing 105. Rim 106 mates with elongated recesses 107, 108 (FIG. 4) in the bottom of scraping plates 22, 23. Although not illustrated, cleaning apparatus 105 may include sealing blocks such as those illustrated in FIGS. 5–9 (e.g., blocks 62 and 63), for cleaning apparatus 29. Because rim 106 projects outwardly from walls 110–113 of housing 105 and includes an inwardly sloping surface 115 which is co-extensive with rim 106, and since cleaning apparatus 104 is utilized with the scraping plates 22, 23 assembled in the quantity-metering device, the cleaning apparatus 104 does not include troughs like those shown at 52, 53 in FIG. 10, for collecting fluid along the outer sides of the housing. Fluid dispensed by nozzles 33–44, will flow between scraping plates 22, 23 and down sloping surface 115 of rim 106, which directs the fluid into housing 105. Since scraping plates 22, 23 remain in place in quantity-metering device 14 when its feed rollers 18, 19 are cleaned using cleaning apparatus 104, the apparatus 104 will clean scraping plates 22, 23 in addition to rollers 18, 19.

Still more particularly, to clean rollers 18 and 19 of quantity-metering device 15, the filler block 21 and die plate 25 are removed from the quantity-metering device 15 through a side access opening (not shown) provided conventionally in food-processing apparatus 14. The cleaning apparatus 29 is then inserted into quantity-metering device 15 at the location vacated by the filler block 21, and die plate 25, through the provided access opening just noted. If the cleaning apparatus 104 is only used to clean the feed rollers, then only die plate 25 is removed from the quantity-metering device 15, and cleaning apparatus 104 is inserted into the location vacated by die plate 25. When cleaning apparatus 29 or cleaning apparatus 104 is fully inserted into the quantity-metering device 15, nozzles 33–44 are positioned to dispense fluid directly onto rollers 18, 19. Hoses 93, 94 are connected to a water supply, which may, for example, be provided by a cart with a fluid reservoir and a pump. The fluid is most preferably supplied to hoses 93, 94 through a pump or pumps (not shown), at a high fluid pressure. When valves 100, 101 are open, fluid from the fluid reservoir pumped into the hoses is supplied through valves 100, 101 to manifolds 31, 32. The fluid output from nozzles 33–44 should have sufficient velocity to dislodge any and all dough or other baking media which adheres to the surface of rollers 18, 19. Because the fluid-dispensing systems **28*a*, 28*b* are slidably supported on housing 30, an operator may hold one or more of pipes 87, 88, 92 and 118 to manipulate the position of manifolds 31, 32, such that nozzles 33–44 spray fluid onto the entire surface of rollers 18, 19, the spray pattern of the nozzles and their relative spacing from one another preferably being such that they will accomplish this goal. Troughs 52, 53, 80 and 81 collect fluid on the exterior of housing 30 to prevent the solution dispensed by systems 28*a*, 28*b* from flowing past the cleaning apparatus into other parts of the food processing device 14. Rim 106 of apparatus 104 similarly prevents fluid from passing beyond cleaning apparatus 104**.

Thus, it can be seen that a cleaning apparatus is disclosed which is easy to install and remove from a quantity-metering device, easy to operate, and which provides thorough and sanitary cleaning. Solution dispensed from the cleaning apparatus will not contaminate other portions of the food-processing apparatus. Furthermore, the cleaning apparatus of the invention is inserted into the depositor apparatus as a single module, and has easy and convenient controls and connection devices. Therefore, the "down time" required to clean the metering device is substantially reduced since very little time is needed to install and cycle the operation of the cleaning apparatus. Since the rollers of the quantity-metering device are cleaned without sanitation personnel contacting them, the rollers are protected from accidental injury and physical contact with cleaning tools, etc.; in addition, the rollers can readily and easily be sanitized by hot water and/or desired solutions applied directly to them from the fluid-distribution manifolds and nozzles.

It is to be understood that the foregoing description of the preferred embodiments of the invention is provided for purposes of the description and illustration, and not as a measure of the invention whose scope is to be defined by reference to the ensuing claims. Thus, those skilled in the art may devise embodiments of the particular concepts presented in the foregoing illustrative disclosure which differ from the particular embodiments shown and described in detail herein or may make various changes in the structural details to the illustrative embodiments. All such alternative or modified embodiments utilize the underlying concepts of the invention and incorporate the spirit thereof are to be considered as within the scope of the claims appended hereinbelow unless such claims, by their language, specifically state otherwise.

The embodiments of the invention in which an exclusive property or privilege is claimed are defined as follows.

1. A cleaning apparatus for volumetric quantity-discharging devices of the type used in the production of food products to dispense edible media from an outlet having a surrounding area defining amounting surface, comprising:

a housing having a mounting base whose shape is directly complimentary to that defined by said surrounding area of said outlet, said housing being adapted to be temporarily and removably secured in place on said mounting surface directly adjacent said quantity-metering device outlet; and means for dispensing fluid under pressure, said means carried by said housing and including fluid-emission means for discharging said fluid into said dispensing outlet, whereby at least portions of said quantity-metering device adjacent and within said outlet are cleaned by the fluid so dispensed and remnant quantities of said media are flushed away;

said cleaning apparatus being removable from said device for further operation thereof in subsequent food product production.

2. The cleaning apparatus as defined in claim 1, wherein said housing is adapted to be secured to said metering device housing in place of and at a location vacated by removable components of said quantity-metering device.

3. The cleaning apparatus as defined in claim 1, wherein said means for dispensing fluid includes at least one manifold having a fluid passage therethrough, said fluid-emission means being in flow communication with said manifold flow passage.

4. The cleaning apparatus as defined in claim 3, wherein said fluid-emission means includes outlet spray nozzles carried on said at least one manifold, whereby fluid in said manifold passage exits said fluid-dispensing means via said nozzles.

5. The cleaning apparatus as defined in claim 4, wherein said at least one manifold is rotatably carried on said cleaning apparatus housing whereby said at least one manifold is rotated to adjust the location where fluid from said nozzles strikes said at least one of said components.

6. The cleaning apparatus as defined in claim 4, wherein said at least one manifold is slidingly carried on said cleaning apparatus housing whereby said at least one manifold is slid to adjust the location where fluid from said nozzles strikes said at least one of said components.

7. The cleaning apparatus as defined in claim 1, wherein said cleaning apparatus housing includes a drain outlet located adjacent a bottom of said housing, whereby fluid discharged by said dispensing means and waste media removed from said metering device exits said cleaning apparatus through said housing drain outlet.

8. The cleaning apparatus as defined in claim 7, wherein said housing includes at least one generally vertical peripheral wall and said at least one wall includes an aperture, and including at least one trough carried on an exterior of said at least one wall for collecting fluids which flow down the exterior thereof, said collected fluid passing through said aperture and into the interior of said housing.

9. The cleaning apparatus as defined in claim 8, including a pair of said troughs, each thereof carried on a different one of two generally vertical walls of said housing, each said trough extending substantially the entire length of its corresponding said wall to collect fluid on an exterior surface of said walls.

10. The cleaning apparatus as defined in claim 1, wherein said housing includes endwalls, and said cleaning apparatus further including a sealing block carried on each said endwall of said housing, said sealing block including troughs which collect fluid on an exterior surface of said sidewalls.

11. The cleaning apparatus as defined in claim 1, wherein said at least one of said components includes at least one feed roller, and said cleaning apparatus housing is adapted to be received in said quantity-metering device housing below said at least one feed roller such that said dispensing means will dispense fluid onto said at least one roller.

12. A cleaning apparatus for a quantity-metering device, which is utilized in the production of food products and has at least one feed roller used to dispense media, comprising:

at least one manifold including a elongated body having a plurality of fluid outlets along its length;

means for removably mounting said manifold on said quantity-metering device at a location directly adjacent and extending along the length of said at least one roller, said manifold when so mounted being free of said roller to permit unrestricted rotation thereof and a plurality of spray nozzles carried on said at least one manifold, each said nozzle including a fluid passage connected to a respective one of said outlets, whereby fluid input to said at least one manifold is dispensed via said nozzles onto and along the length of said at least one feed roller to remove waste media from and clean said at least one feed roller, said feed roller being rotatable within the spray pattern of said nozzles to clean substantially all of its outer periphery.

13. The cleaning apparatus as defined in claim 12, including a plurality of said manifolds.

14. The cleaning apparatus as defined in claim 12, wherein a respective manifold is provided in said cleaning apparatus for each roller in said quantity-metering device.

15. The cleaning apparatus as defined in claim 12, further including a support for said at least one manifold, said support supporting said at least one manifold on said quantity-metering device, said at least one manifold rotatably carried on said support whereby said at least one manifold is rotated to adjust the location where fluid from said nozzles strikes said at least one feed roller.

16. The cleaning apparatus as defined in claim 12, further including a support for said at least one manifold, said support supporting said at least one manifold on said quantity-metering device, said at least one manifold slidingly carried on said support whereby said at least one manifold is slid to adjust the location where fluid from said nozzles strikes said at least one feed roller.

17. A method of cleaning a roller of a volumetric quantity-metering device utilized to dispense edible media from an outlet in the production of food products, comprising the steps of:

assembling a cleaning apparatus to said quantity metering device at a location directly adjacent said roller, said cleaning apparatus including a housing which carries means for dispensing fluid, said means including a manifold defining a fluid passage and a plurality of spray nozzles carried on said manifold, said spray nozzles including a fluid passage connected to the fluid passage in the manifold, said nozzles adapted to receive fluid from said fluid passage in said manifold;

said step of assembling including temporarily and removably securing said housing in place upon a correspondingly shaped part of said quantity-metering device; and applying fluid to said fluid dispensing means whereby said fluid inputs to said dispensing means is supplied to said manifold and dispensed onto said roller through nozzles.

18. The method as defined in claim 17, further including a step of removing a component from said quantity-metering device, and said step of assembling includes positioning said cleaning apparatus housing in the location in said quantity-metering device vacated by the said removal of said quantity-metering device component and temporarily securing said cleaning apparatus in said location.

* * * * *